US007444849B1

(12) United States Patent
Hsueh et al.

(10) Patent No.: US 7,444,849 B1
(45) Date of Patent: Nov. 4, 2008

(54) PIPE BENDING APPARATUS

(76) Inventors: Paul Hsueh, 4790 Myrtle Dr., Concord, CA (US) 94521; Kie Hong Lao, 2552 S. King Rd., Apt. 27, San Jose, CA (US) 95122

( * ) Notice: Subject to any disclaimer, the term of this patent is extended or adjusted under 35 U.S.C. 154(b) by 0 days.

(21) Appl. No.: 11/764,216

(22) Filed: Jun. 17, 2007

(51) Int. Cl.
*B21D 7/04* (2006.01)
*B21J 9/18* (2006.01)

(52) U.S. Cl. ..... 72/149; 72/449

(58) Field of Classification Search ..... 72/149–159, 72/449
See application file for complete search history.

(56) References Cited

U.S. PATENT DOCUMENTS 1,762,234 A * 6/1930 Matthews ..... 72/218
1,910,832 A * 5/1933 Henderson ..... 72/321
2,989,109 A * 6/1961 Heimberger ..... 72/369

* cited by examiner

*Primary Examiner*—Teresa Bonk

(57) ABSTRACT

The present invention of pipe-bending apparatus includes: a frame, a bending shoe having gear teeth and concave groove on its outer circumference, a drive-gear, a gear rack having gear teeth and concave groove on one surface and gear teeth only on opposite surface. The frame pivotally supports bending shoe and drive-gear, positions gear rack engaging bending shoe and drive-gear. When using the pipe-bending apparatus, a straight pipe is laid inside the groove on gear rack with one pipe portion secured to bending shoe. Force is applied to turn drive gear, with all gear components engaged, gear rack and pipe transverse downwards and turns bending shoe. With one pipe portion secured to and turning with bending shoe, the pipe begins bending inside the concave groove on bending shoe.

6 Claims, 14 Drawing Sheets

PIPE BENDING APPARATUS

CROSS-REFERENCES TO RELATED APPLICATIONS

Not applicable.

STATEMENT REGARDING FEDERALLY SPONSORED RESEARCH OR DEVELOPMENT

Not applicable.

TECHNICAL FIELD

The present invention relates generally to a pipe bending system, and more particularly to an improved pipe bending apparatus.

SUMMARY OF THE INVENTION

The present invention pipe bending apparatus includes: a U-shaped frame having a front arm and a rear arm; a semicircular bending shoe having a row of gear teeth and a semicircular concave groove on outer circumference of the bending shoe; a cylindrical drive-gear having a row of gear teeth on its outer circular surface; and a rectangular gear rack board with gear teeth and a semicircular concave groove on one side of the board and gear teeth only on the opposite side. With two arms, the frame pivotally supports the bending shoe and the drive-gear, positions the gear rack in-between the bending shoe and the drive gear. When the pipe-bending apparatus is in use, a straight pipe is laid inside the concave groove on the gear rack with one pipe end or portion inserted through a locking ring, formed half by the semicircular concave groove on the bending shoe and half by the matching semicircular concave groove on a U-shaped bracket affixed to the bending shoe. A force is applied to and turns the drive-gear, which is engaged to the gear rack first and then to the bending shoe. By the rotating force, the gear rack moves downward together with the pipe and causes the bending shoe to turn. Since one end or portion of the pipe is locked inside the locking ring and secured to the bending shoe, thus the pipe turns together with the bending shoe, causing the pipe to bend along the concave groove on the bending shoe.

The pipe bending apparatus of the present invention has these features and benefits: (1) the pipe to be bent is uniformly supported by semicircular groove on the gear rack for feeding to the bending shoe for bending, there is less concentrated force applied to the pipe therefore less chances of crimping and deforming the pipe; (2) with gear teeth engaged among the components, slippages between the components are minimized, exact and accurate bending angle of the pipe can be achieved; (3) the pipe-bending apparatus is compact and portable, thus operable in shallow and tight spaces; (4) changing the bending shoe and gear rack for pipe of different size is easy.

Additional advantages of the present invention will become readily apparent with the following description of the preferred embodiment while referencing to the detailed drawings. The invention illustrated in the drawings should not be viewed as a limitation of the present invention but merely as depicting embodiments thereof.

BACKGROUND OF THE INVENTION

There are many pipe-bending apparatus in the industries for various applications such as for manufacturing large quantities of pipes in a factory or producing smaller quantities in a machine shop or bending a few pipes needed for repair jobs at job site. Also, different pipe-bending apparatus have different features such as utilizing manual, electrical, or hydraulic powers. Some prior arts of pipe-bending apparatus are disclosed in U.S. Pat. Nos. 4,355,528, 4,926,672, 5,469,730, and 5,499,521, etc.

The prior art of U.S. Pat. No. 4,355,528 includes a pressing block for pressing the pipe against the bending shoe, and a long handle attached to the pressing block for rotating the pressing block around the bending shoe for bending the pipes. The long handle, as also required in many other prior arts, demands a bigger operating space, which may not always be available.

The prior art of U.S. Pat. No. 4,926,672 has a bending shoe installed on a stand and a handle attached to the bending shoe. By applying force to the handle and rotate the bending shoe, the pipe is bent. However, the portion of the pipe supported by the stand is being dragged and sliding on the stand, creating localized stress on the pipe resulting in deformation or surface damage to the pipe.

The present invention of pipe-bending apparatus includes several features that are different and improved from the prior arts. Benefits from these features will be shown by the detailed description of the present invention thereafter.

BRIEF DESCRIPTION OF THE DRAWINGS

FIG. 5A is a perspective view of the gear rack installed onto the frame assembly according to the first embodiment of the present invention.

DETAILED DESCRIPTION OF THE PREFERRED EMBODIMENT

Figure 1:
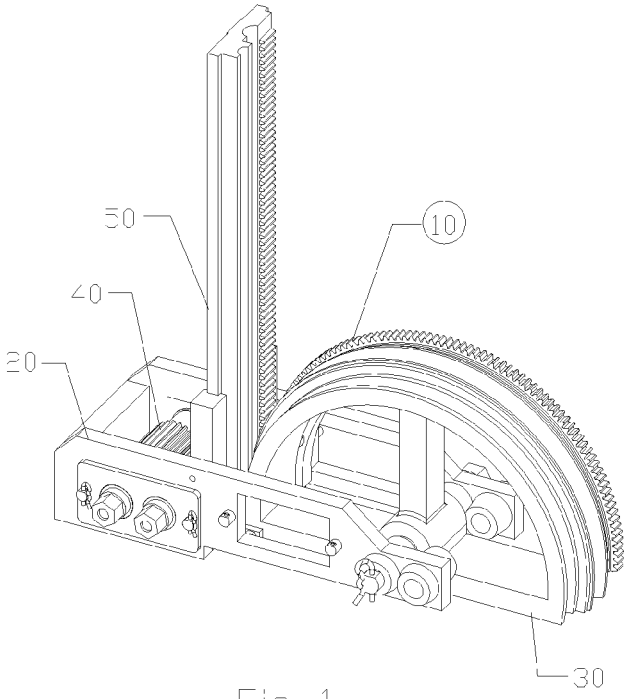
FIG. 1 is a perspective view of the pipe-bending apparatus according to the first embodiment of the present invention.

As shown in FIG. 1, according to the first embodiment of the present invention, the pipe-bending apparatus 10 includes a frame assembly 20, a bending shoe assembly 30, a drive-gear assembly 40, and a gear rack 50.

Figure 2:
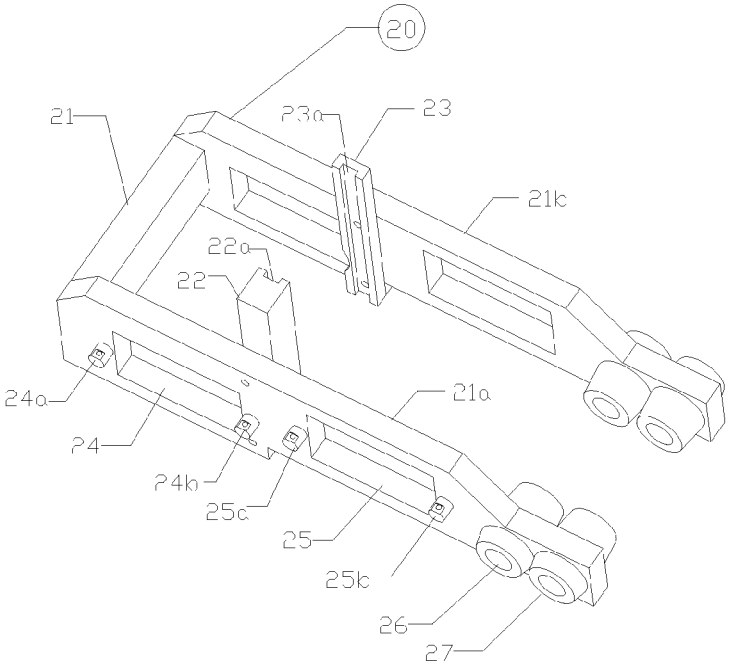
FIG. 2 is a perspective view of the frame assembly according to the first embodiment of the present invention.

FIG. 2 shows frame assembly 20, which includes a U-shaped frame 21 and firmly affixed U-channels 22 and 23 with U-shaped grooves 22*a* and 23*a*. Frame 21 includes a front arm 21*a* and a rear arm 21*b*, both having openings 24 and 25, through holes 26 and 27, and protrusions 24*a*, 24*b*, 25*a* and 25*b* (protrusions on frame rear portion 21 are not visible in this view).

Figure 3:
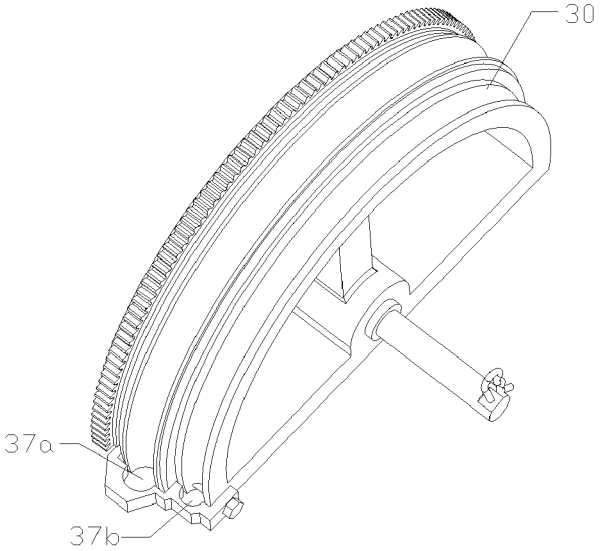
FIG. 3 is a perspective view of the bending shoe assembly according to the first embodiment of the present invention.

FIG. 3 shows bending shoe assembly 30 having two circumferential cavities 37*a* and 37*b*.

Figure 3A:
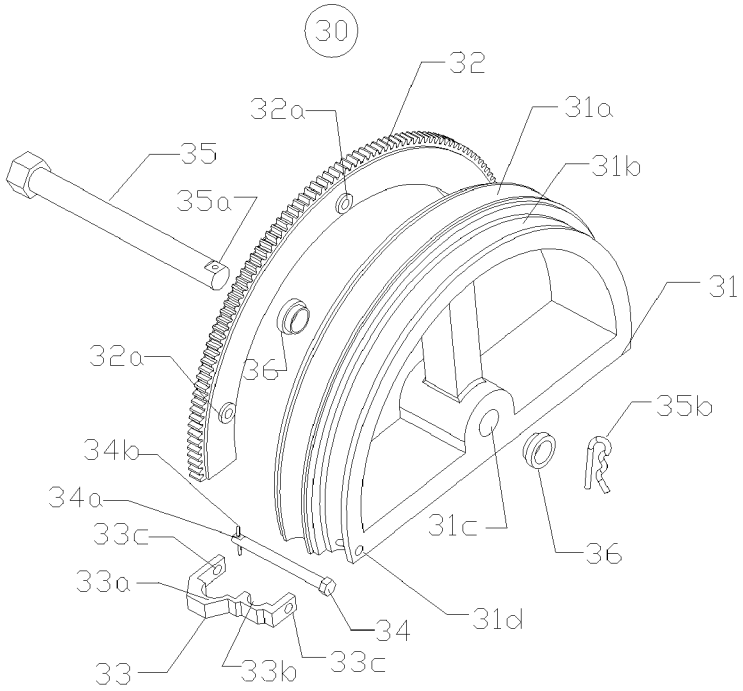
FIG. 3A is a perspective view of the components of the bending shoe assembly of FIG. 3.

As shown in FIG. 3A, the components in bending shoe assembly 30 include: a bending shoe 31 with semicircular grooves 31*a* and 31*b* on the outer circumferential peripheral, holes 31*c* and 31*d*, a circumferential gear sector 32 with holes 32*a*, a U bracket 33 with semicircular grooves 33*a* and 33*b*, and holes 33*c*, a pin 34 with a hole 34*a*, a spring pin 34*b*, a bolt pin 35 with a hole 35*a*, a spring pin 35*b*, and two bearings 36 in the form of flange bushings.

When bending shoe assembly 30 is fully assembled, bearings 36 are firmly affixed into bending shoe hole 31*c*, bolt 35 is placed through bearings 36, and spring pin 35*b* is placed through hole 35*a* on bolt pin 35, gear sector 32 is firmly affixed to bending shoe 31 by bolts (not shown) placing through holes 32*a* and holes (not shown) on bending shoe 31, holes 33*c* on U bracket 33 are aligned with hole 31*d* on bending shoe, and pin 34 is inserted through hole 33*c* and 31*d*, and spring pin 34*b* is inserted through hole 34*a* on pin 34 to keep pin 34 in place, such that bracket 33 is pivotally attached to bending shoe 31 with grooves 33*a* and 33*b* on bracket 33 aligned with grooves 31*a* and 31*b* on bending shoe 30.

Referring to FIG. 3 again, when bending shoe assembly 30 is assembled together, semicircular grooves 33*a*, 33*b* on U-bracket 33 and semicircular grooves 31*a*, 31*b* on bending shoe 31 jointly form two circumferential cavities 37*a* and 37*b* for insertion of at least one circumferential pipe to be bent.

Figure 3B:
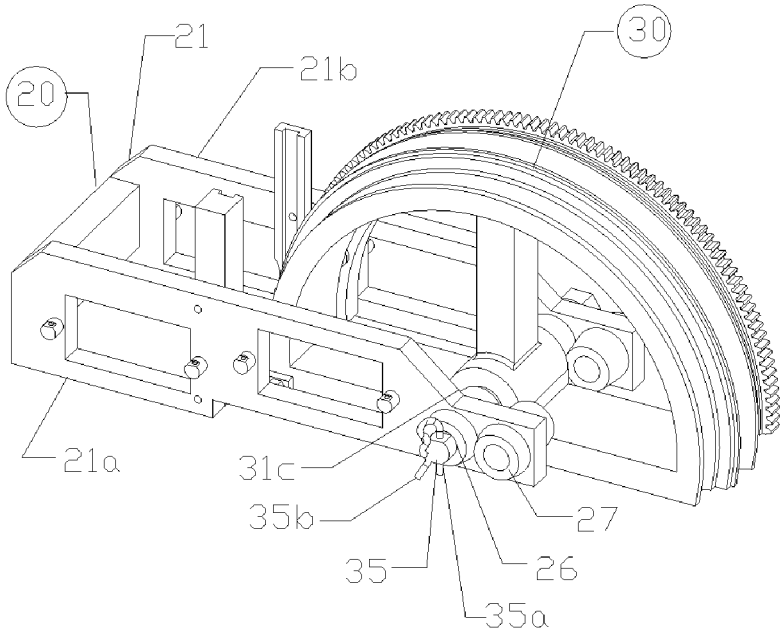
FIG. 3B is a perspective view of the bending shoe assembly installed onto the frame assembly according to the first embodiment of the present invention.

Referring to FIG. 3B, when bending shoe assembly 30 is installed onto frame assembly 20, bending shoe assembly 30 is fitted between front frame arm 21*a* and rear frame arm 21*b* with bending shoe hole 31*c* aligned with frame holes 26, and bolt pin 35 is inserted through them and spring pin 35*b* is insert through hole 35*a* on bolt pin 35 to keep pin 35 in place, such that bending shoe assembly 30 is able to rotate around bolt pin 35. Holes 27 on frame 21 allows a bigger circumferential bending shoe to be installed onto frame assembly 20.

Figure 4:
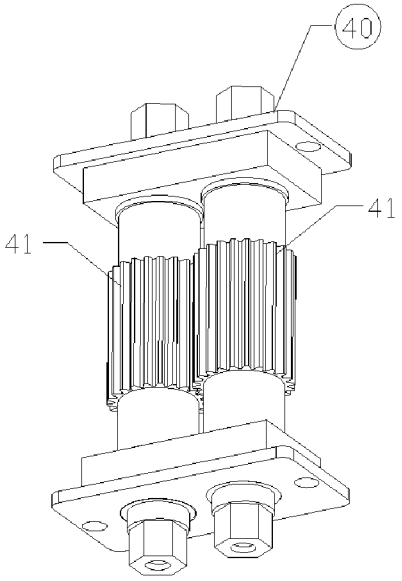
FIG. 4 is a perspective view of the drive-gear assembly according to the first embodiment of the present invention.

FIG. 4 shows drive-gear assembly 40 having two identical gears 41 engaged to each other.

Figure 4A:
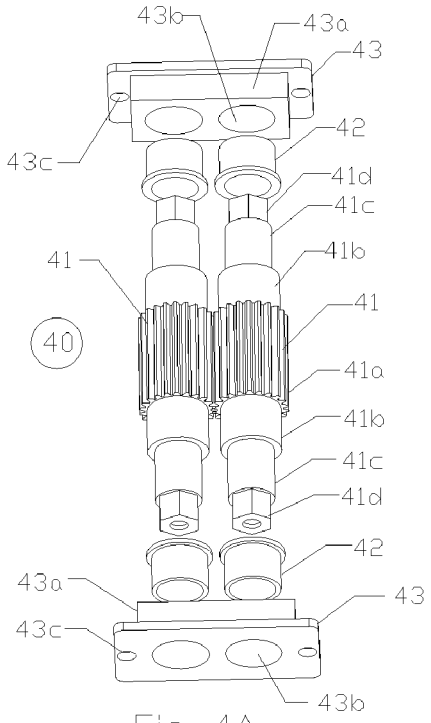
FIG. 4A is a perspective view of the components of the drive-gear assembly of FIG. 4.

FIG. 4A shows the components in drive-gear assembly 40 includes: two gears 41, four bearings 42 in the form of flange bushings, and two end caps 43, each having two holes 43*c* and a protruding portion 43*a* with two holes 43*b*. Each gear 41 has circumferential gear teeth 41*a*, cylindrical surfaces 41*b* and 41*c* of reduced diameters, and hexagonal ends 41*d*.

When drive-gear assembly 40 is assembled together, bearings 42 are firmly affixed to corresponding holes 43*b*, and drive-gear surfaces 41*c* fit inside holes of corresponding bearings 42 such that gear 41 can rotate inside end caps 43. Same installation is applied to both drive-gear 41. Gear teeth 41*a* on two drive-gears 41 are engaged to each other.

Figure 4B:
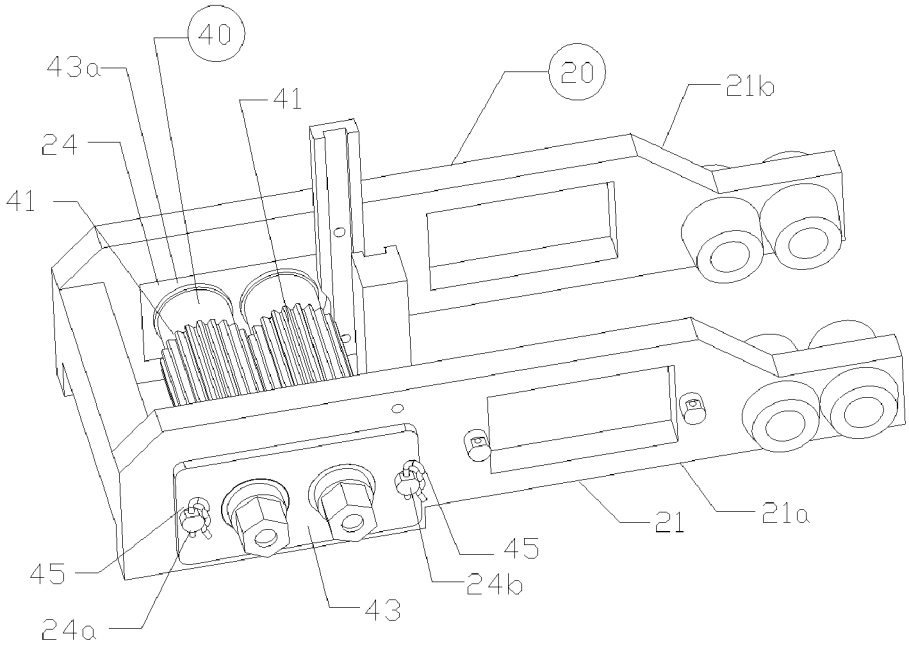
FIG. 4B is a perspective view of the drive gear assembly installed onto the frame assembly according to the first embodiment of the present invention.

FIG. 4B shows drive-gear assembly 40 assembled into frame assembly 20. Drive-gear assembly 40 (without end caps 43) is place between front frame arm 21*a* and rear frame arm 21*b*. End caps 43 each having protruding portions 43*a* are inserted toward and fitted into rectangular holes 24 (also shown in FIG. 2), and protrusions 24*a* and 24*b* on frame 21 protrude through the holes on end caps 43. Four spring pins 45 are individually inserted through a hole on protrusions 24*a*, 24*b* on front frame arm 21*a* and rear frame arm 21*b* to keep end caps 43 attached to frame assembly 20. Drive gears 41 are able to rotate inside frame assembly 20.

Figure 5:
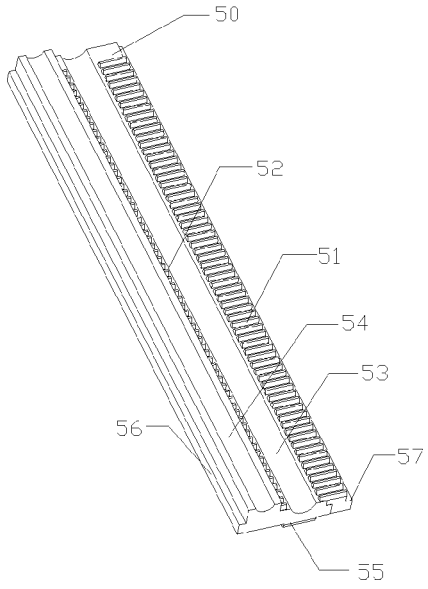
FIG. 5 is a perspective view of the gear rack according to the first embodiment of the present invention.
Figure 54:
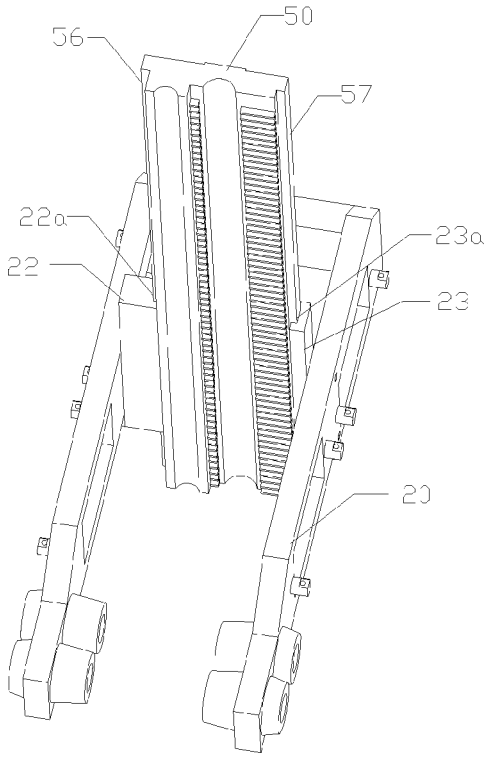

FIG. 5 shows gear rack 50 having two roles of gear teeth 51 and 52, two semicircular grooves 53 and 54 on one side, and one row of gear teeth 55 (not visible in this view) on the opposite side. Gear rack 50 also has two custom shaped edges 56 and 57 for fitting into the grooves 22*a* and 23*a* of frame assembly 20 (as shown in FIG. 2).

Referring to FIG. 5A, when gear rack 50 is installed onto frame assembly 20, gear rack edges 56 and 57 each is fitted into grooves 22*a* and 23*a* respectively on U-channels 22 and 23 on frame assembly 20. Gear rack 50 is able to slide inside grooves 22*a* and 23*a*.

Figure 6:
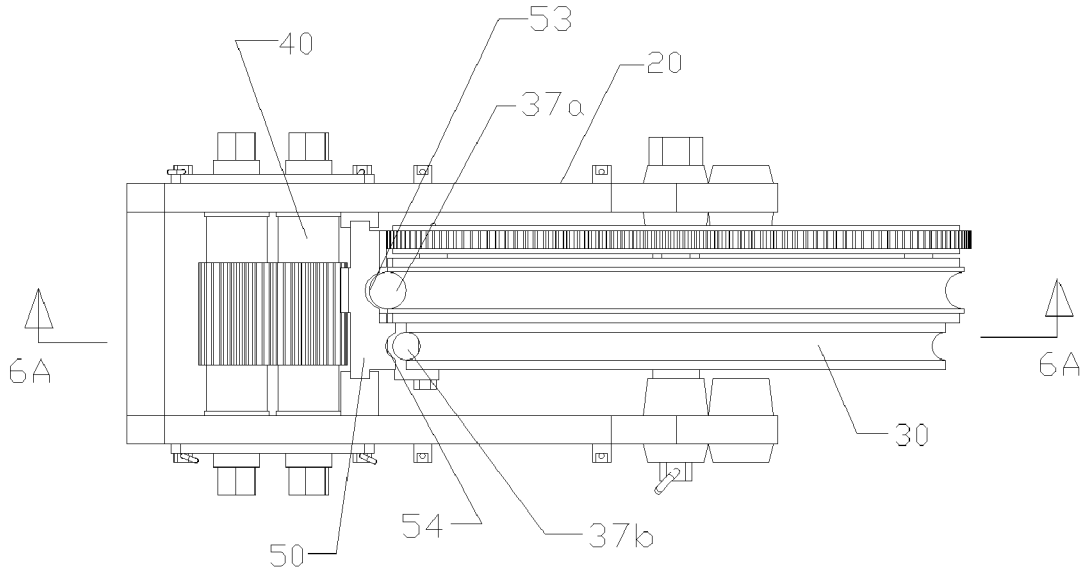
FIG. 6 is a top view of the bending shoe assembly, the drive-gear assembly and the gear rack installed onto the frame assembly according to the first embodiment of the present invention.

FIG. 6 shows a top view of frame assembly 20 when bending shoe assembly 30, drive-gear assembly 40, and gear rack 50, are installed onto frame assembly 20. The semicircular grooves on gear rack 50 are concentric with the two circumferential cavities 37A and 37B (also show in FIG. 3) when bending shoe assembly is in this position, such that circumferential straight pipes can be inserted along semicircular grooves 53 and 54 and into cavities 37*a* and 37*b*.

Figure 7:
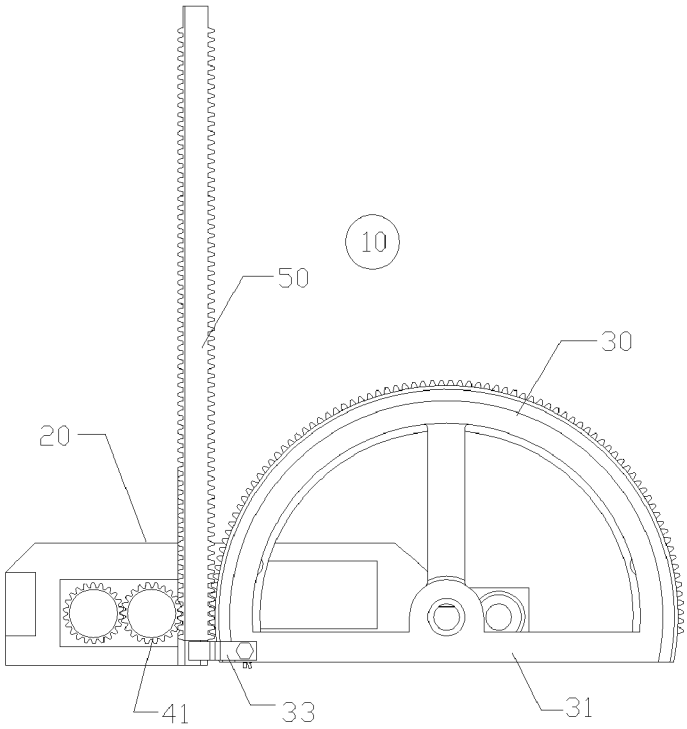
FIG. 7 is a cross sectional (along line 6A-6A in FIG. 6) front view of the bending shoe assembly, the drive-gear assembly and the gear rack installed onto the frame assembly according to the first embodiment of the present invention.

FIG. 7 shows a view taken from FIG. 6 along arrows 6A to 6A. The gear teeth are engaged from drive gear 41 to gear rack 50, and to bending shoe assembly 30, such that when drive gear 41 is being rotated, the rotating motion will transmit to gear rack 50, and to bending shoe assembly 30. As shown, gear rack 50 is at its transverse upper limit location, and bending shoe assembly 30 is at its clockwise rotation limit, such that at these settings, a straight circumferential pipes (not shown) can be inserted along semicircular grooves (shown in FIG. 6) on gear rack 50 and through cavities 37*a* or 37*b* (shown in FIG. 3) formed between U-bracket 33 and bending shoe 31. For this reason, the settings of gear rack 50 and bending shoe assembly 30 shown are used as the beginning settings for bending a straight pipe.

Figure 8:
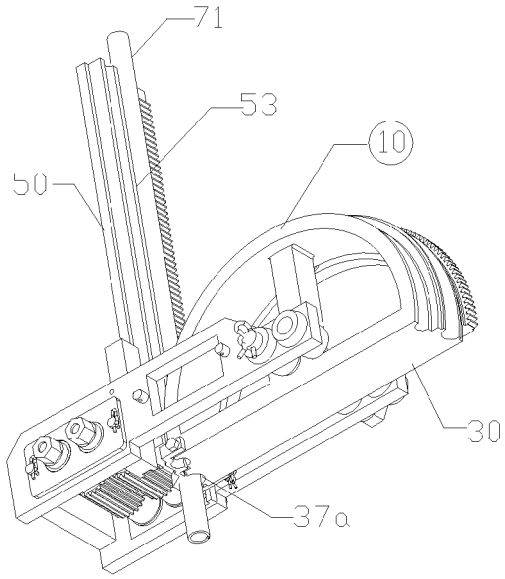
FIG. 8 is a perspective view of the pipe-bending apparatus with a straight pipe installed therein according to the first embodiment of the present invention.

FIG. 8 shows pipe-bending apparatus 10 with a straight pipe 71 inserted along semicircular groove 53 on gear rack 50 and into circumferential cavity 37*a* on bending shoe assembly 30.

Figure 9:
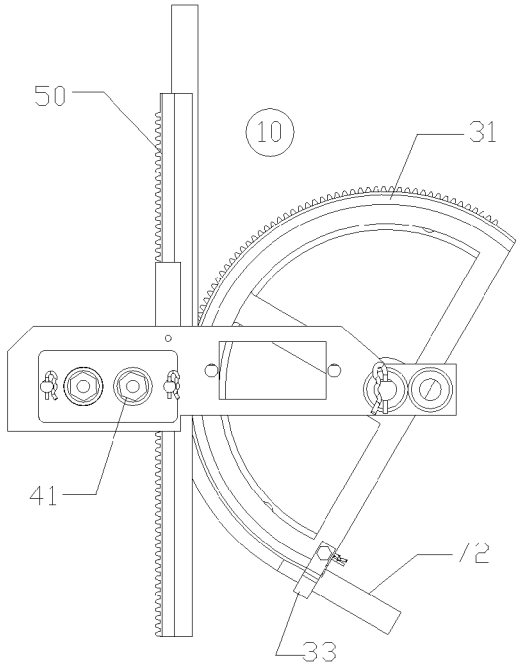
FIG. 9 is a front view of the pipe-bending apparatus with a bent pipe installed therein according to the first embodiment of the present invention.

FIG. 9 shows pipe-bending apparatus 10 with a bent pipe 72 after a pipe bending process, such that drive-gear 41 was rotated clockwise by an applied rotating motion (not shown), and through the gear teeth engagement from drive-gear 41 to gear rack 50 and to bending shoe 31, gear rack 50 had been transverse downwards, bending shoe 31 was rotated counter clockwise. With bending shoe 31 having pipe 72 lower portion held by bracket 33 close to bending shoe 31, pipe 72 was bent along semicircular grooves on bending shoe 31.

Pipe-bending apparatus 10 has a pipe-bending process similar to a rolling mill action because the pipe is supported and fed to bending shoe 31 by gear rack 50 and rolled by the rotating bending shoe into shape. Because pipe 72 to be bent portion entirety is supported by semicircular groove on gear rack 50, there are less concentrated force applied to the pipe and thus has less tendencies of deforming and crimping the pipe.

Figure 10:
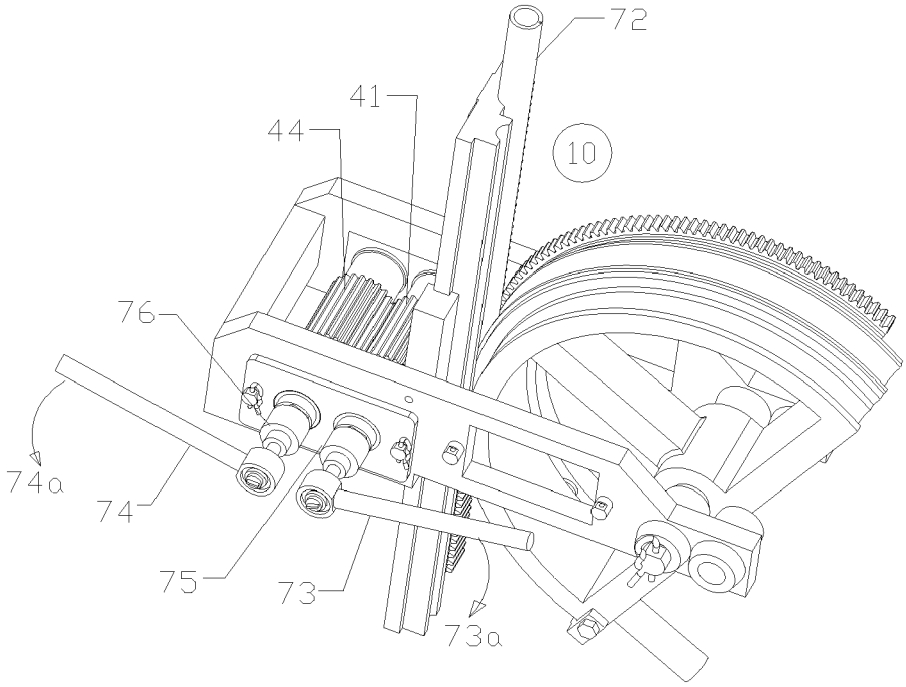
FIG. 10 is a perspective view of the bending apparatus with a bent pipe installed therein according to the first embodiment of the present invention.

FIG. 10 shows two forces 73*a* and 74*a* are being applied to two ratchets 73 and 74 with sockets 75 and 76 connected to the hexagonal end of each drive-gears 41 respectively for applying torque to drive-gears 41 for bending the pipe. When ratchets 73 and 74 are turned by both hands at the same time, the applied torque to the tool is doubled, and it is easier for a person to apply the forces too.

Figure 11:
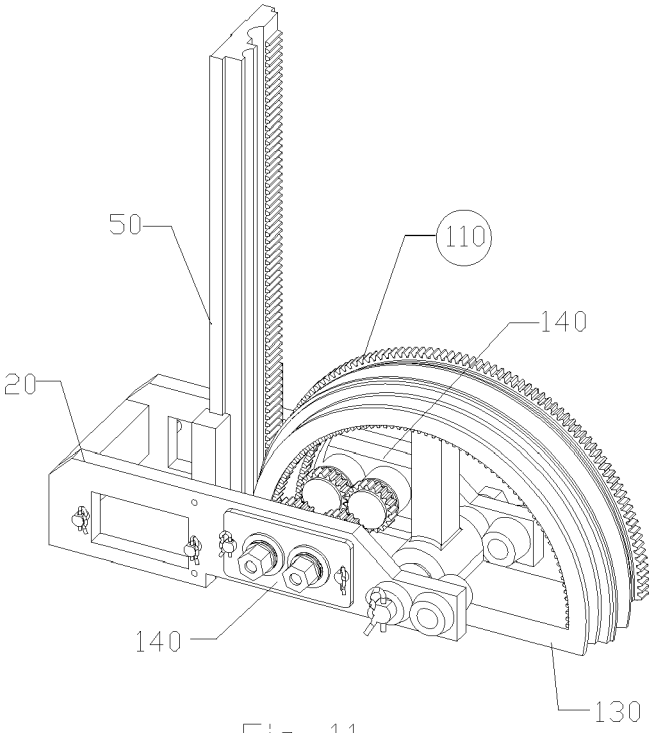
FIG. 11 is a perspective view of the pipe-bending apparatus according to the second embodiment of the present invention.

FIG. 11 shows a pipe-bending apparatus 110 according to the second embodiment of the present invention.

As shown in FIG. 11, pipe-bending apparatus 110 includes a frame assembly 20, a bending shoe assembly 130, two of drive-gear assemblies 140, and a gear rack 50. Frame assembly 20 and gear rack 50 are the same as were described in the first embodiment of the present invention, so that these components will not be illustrated again.

Figure 12:
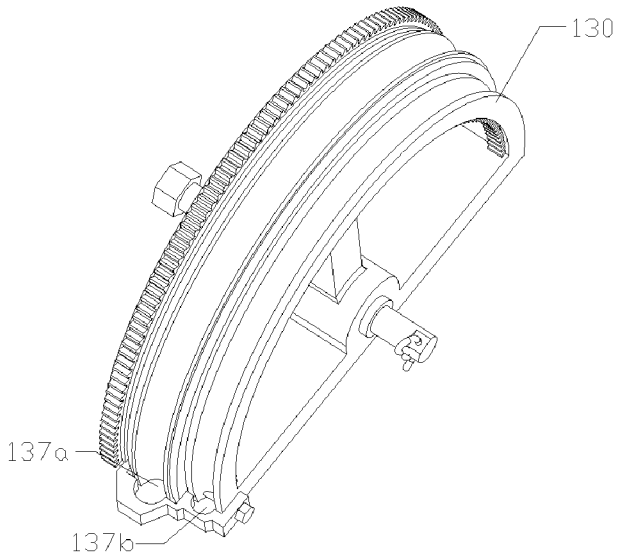
FIG. 12 is a perspective view of the bending shoe assembly according to the second embodiment of the present invention.

FIG. 12 shows bending shoe assembly 130 having two circumferential cavities 137*a* and 137*b*.

Figure 12A:
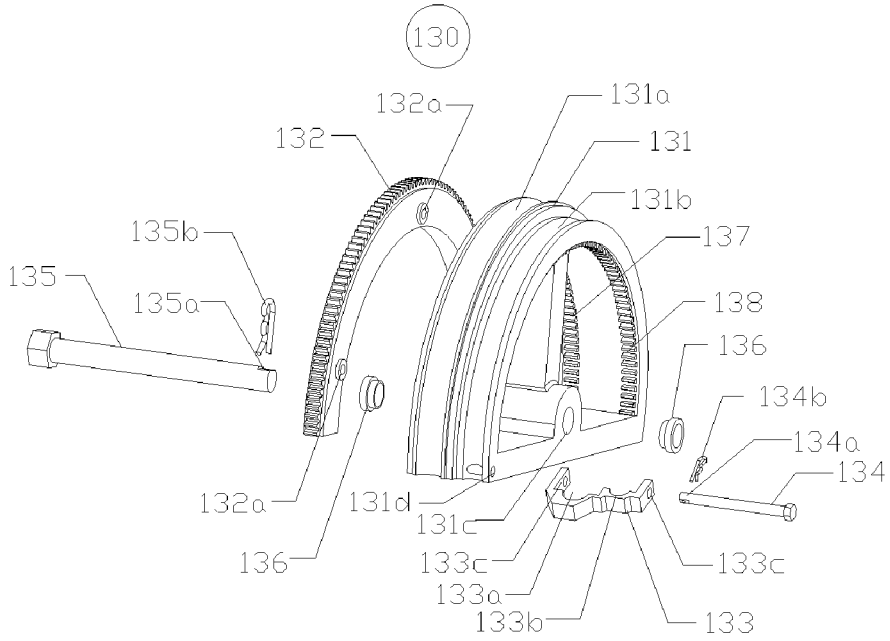
FIG. 12A is a perspective view of the components of the bending shoe assembly of FIG. 12.

FIG. 12A shows the components in bending shoe assembly 130 including: a bending shoe 131 having semicircular grooves 131*a* and 131*b* on the outer circumferential peripheral, two rows of circumferential internal gear teeth 137 and 138, holes 131*c* and 131*d*, a circumferential gear sector 132 having holes 132*a*, a U bracket 133 having semicircular grooves 133*a* and 133*b*, and holes 133*c*, a pin 134 having a hole 134*a*, a spring pin 134*b*, a pin 135 having a hole 135*a*, a spring pin 135*b*, and two bearings 136 in the form of flange bushings.

When the components in bending shoe assembly 130 are being assembled, bearings 136 are firmly affixed into bending shoe hole 131*c*, bolt 135 is placed through bearings 136, and spring pin 135*b* is placed through hole 135*a* on bolt 135, gear sector 132 is firmly affixed to bending shoe 131 by bolts (not shown) placing through holes 132*a* and holes (not shown) on bending shoe 131, holes 133*c* on U bracket 133 are aligned with hole 131*d* on bending shoe, and bolt 134 is inserted through hole 133*c*, 131*d*, and 133*c*, and spring pin 134*b* is inserted through hole 134*a* on pin 134 to keep pin 134 in place, such that bracket 133 is pivotally attached to bending shoe 131 with grooves 133*a* and 133*b* on bracket 133 aligned with grooves 131*a* and 131*b* on bending shoe 130.

Referring also back to FIG. 12, when the components in bending shoe assembly 130 are assembled together, semicircular grooves on U-bracket 133 and semicircular grooves on bending shoe 131 have formed two circumferential cavities 137*a* and 137*b*, such that circumferential pipes can be inserted through therein.

Figure 12B:
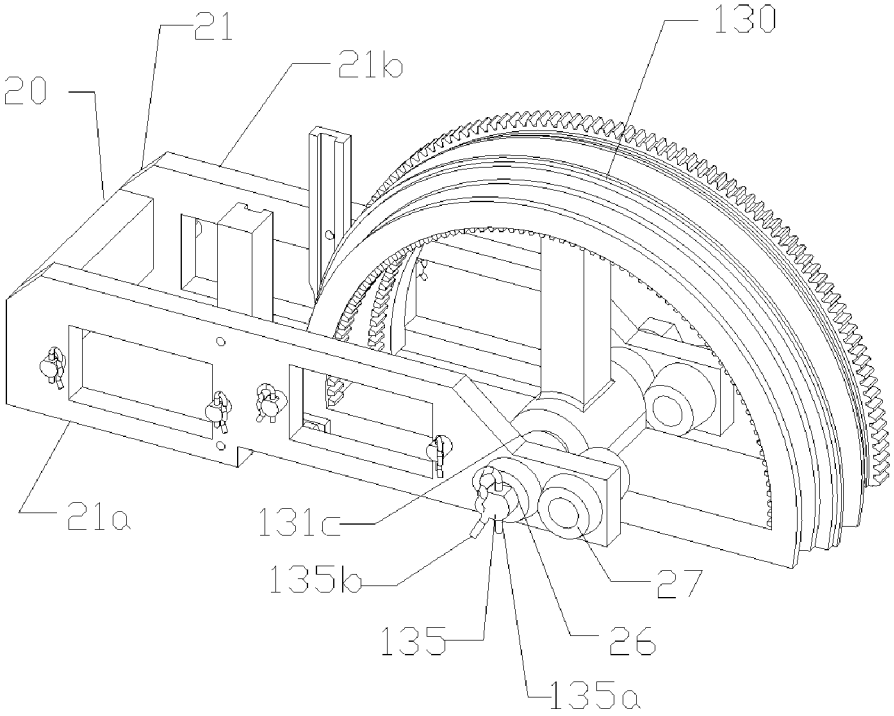
FIG. 12B is a perspective view of the bending shoe assembly installed onto the frame assembly according to the second embodiment of the present invention.

Referring to FIG. 12B, when bending shoe assembly 130 is installed onto frame assembly 20, bending shoe assembly 130 is fitted between front frame arm 21*a* and rear frame arm 21*b*, hole 131*c* on bending shoe aligned with holes 26 on frame 21, and pin 135 is inserted through the holes, spring pin 135*b* is insert through hole 135*a* on pin 135 fixing pin 135 in place, such that bending shoe assembly 130 is able to rotate around pin 135. Hole 27 on frame 21 allows a bigger circumferential bending shoe to be installed onto frame assembly 20.

Figure 13:
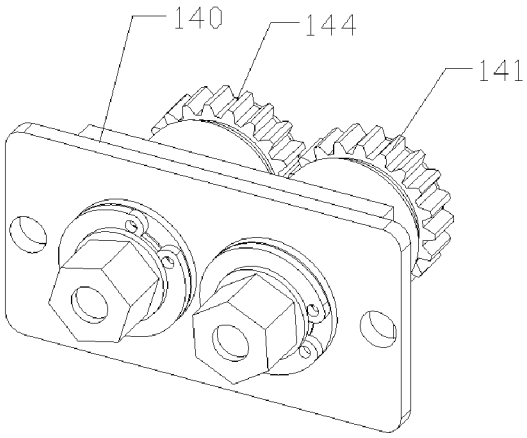
FIG. 13 is a perspective view of the drive-gear assembly according to the second embodiment of the present invention.

FIG. 13 shows drive-gear assembly 140 having gears 141 and 144.

Figure 13A:
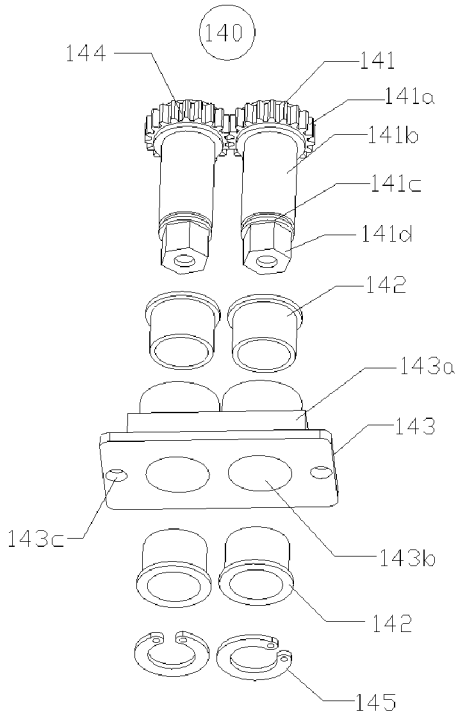
FIG. 13A is a perspective view of the components of the drive-gear assembly of FIG. 13.

FIG. 13A shows drive-gear assembly 140 components, which includes: drive gears 141 and 144, four bearings 142 in the form of flange bushings, an end cap 143 having two holes 143*c* and a protruding rectangular portion 143*a* having two holes 143*b*, and two of retaining rings 145. Drive-gear 141 includes a circumferential gear teeth 141*a*, a reduced circumferential diameter surfaces 141*b*, a groove 141*c*, and a hexagonal end 141*d*. Drive gear 144 is identical to drive gear 141.

When drive-gear assembly 140 is assembled, bearings 142 are firmly affixed to holes 143*b*, surface 141*b* of gear 141 fits inside bearings 142, such that drive gear 141 is able to rotate inside end cap 143, and retaining ring 145 is placed onto groove 141*c* to keep drive gear 141 therein. Gear 144 is installed the same way. Teeth on gear 141 and gear 144 are engaged.

Figure 13B:
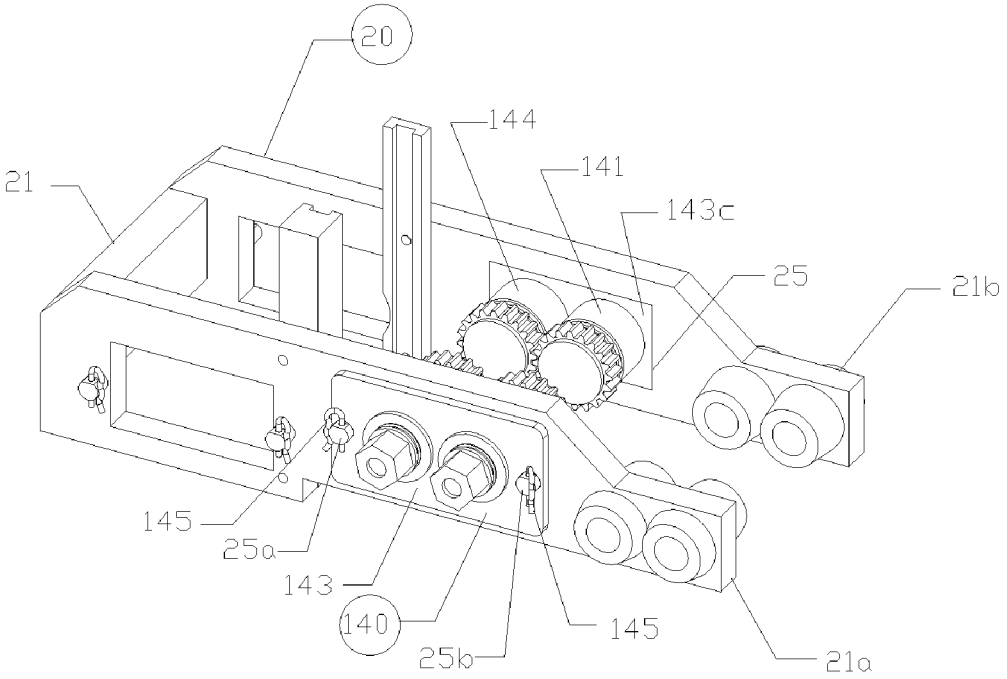
FIG. 13B is a perspective view of the drive-gear assembly installed onto the frame assembly according to the second embodiment of the present invention.

FIG. 13B shows when two of drive-gear assembly 140 are assembled into frame assembly 20, such that each drive-gear assembly 140 end cap 143 protruding rectangular portion is inserted toward and fitted into holes 25 (also shown in FIG. 2) on frame 21, and protrusions 25*a* and 25*b* on frame 21 protrude through the holes on end caps 143. Four of spring pins 145 are inserted through holes on protrusions 25*a* and 25*b* on both the front arm 21*a* and rear arm 21*b* in order to keep end caps 143 attached to frame assembly 20. Gears 141 and 144 are able to rotate inside frame assembly 20.

Figure 14:
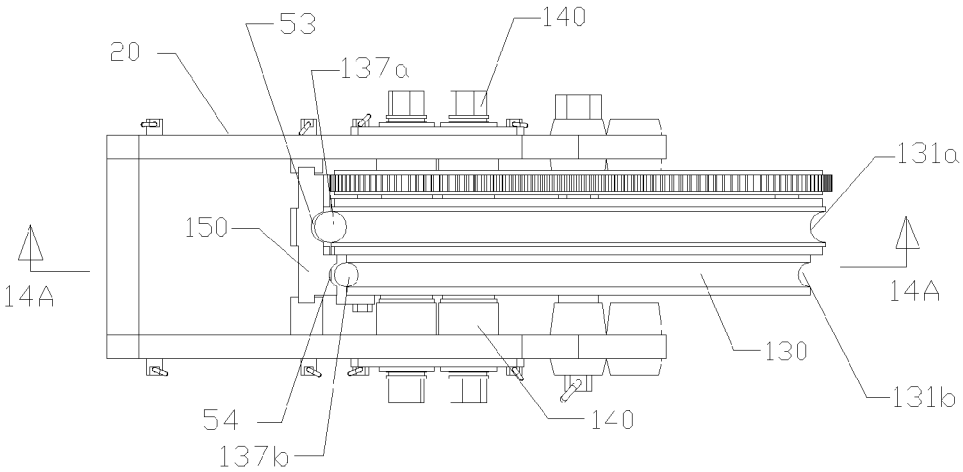
FIG. 14 is a top view of the bending shoe assembly, the drive gear assembly and the gear rack installed onto the frame assembly according to the second embodiment of the present invention.

FIG. 14 shows a top view of frame assembly 20 when bending shoe assembly 130, drive-gear assemblies 140, and gear rack 50, are installed onto frame assembly 20. The semicircular grooves 53 and 54 on gear rack 50 are concentric with two semicircular grooves 131*a* and 131*b* of forming two circumferential cavities 137*a* and 137*b* (also show on FIG. 12) when bending shoe assembly is in this position, such that circumferential straight pipes can be inserted along semicircular grooves 53 and 54 on gear rack 50 and into cavities 137*a* and 137*b*.

Figure 15:
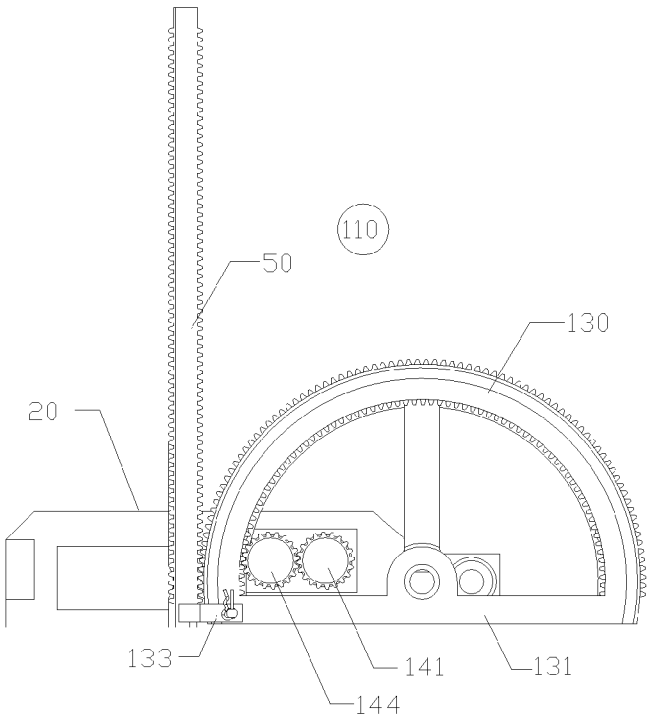
FIG. 15 is a cross sectional (along line 14A-14A in FIG. 14) front view of the bending shoe assembly, the drive gear assembly and the gear rack installed onto the frame assembly according to the second embodiment of the present invention.

FIG. 15 shows a view taken from FIG. 14 along arrows 14A to 14A. The gear teeth are engaged from drive-gear 141, drive-gear 144, bending shoe assembly 130, and to gear rack 50, such that when drive-gear 141 is being rotated, the rotating motion will transmit through drive-gear 144, bending shoe assembly 130, and to gear rack 50. As shown, gear rack 50 is at its transverse upper limit location, and bending shoe assembly 130 is at its clockwise rotation limit, such that at these settings, straight circumferential pipes (not shown) can be inserted along semicircular grooves 53 and 54 (shown in FIG. 14) on gear rack 50 and through cavities 137*a* or 137*b* (also shown in FIG. 12) formed between the U-bracket and the bending shoe. For this reason, the positions settings of gear rack 50 and bending shoe assembly 130 shown are used as the beginning settings for bending a straight pipe.

Figure 16:
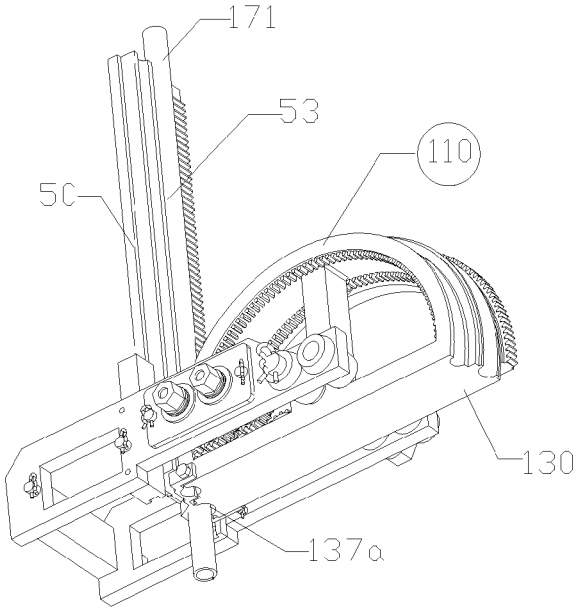
FIG. 16 is a perspective view of the pipe-bending apparatus with a straight pipe installed therein according to the second embodiment of the present invention.

FIG. 16 shows pipe-bending apparatus 110 with a straight pipe 171 inserted along semicircular groove 53 on gear rack 50 and into circumferential cavity 137*a* on bending shoe assembly 130.

Figure 17:
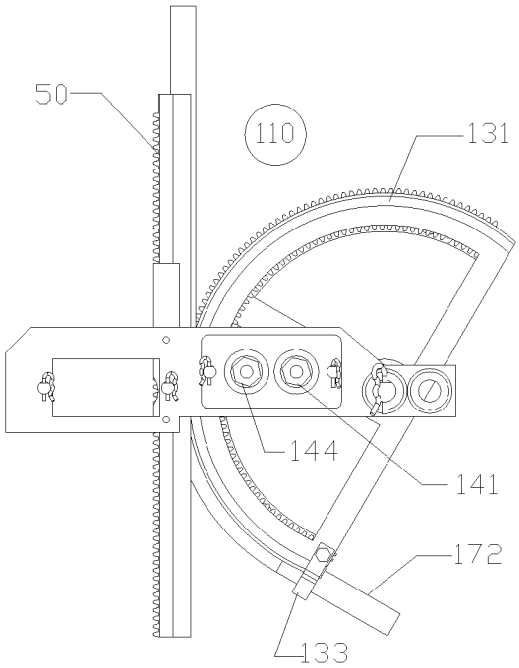
FIG. 17 is a front view of the pipe-bending apparatus with a bent pipe installed therein according to the second embodiment of the present invention.

FIG. 17 shows pipe-bending apparatus 110 with a bent pipe 172 after a pipe bending process, such that drive gear 141 was rotated clockwise by an applied rotating motion (not shown), and through the gear teeth engagement from drive gear 141 to drive gear 144 to bending shoe 131 and to gear rack 50, bending shoe 131 was rotated counterclockwise. With bending shoe 131 having the lower portion of pipe 172 held by bracket 133 close to bending shoe 131, pipe 172 was bent along semicircular grooves on bending shoe 131, and gear rack 50 was transverse downwards of feeding pipe 172 into bending shoe 131.

Figure 18:
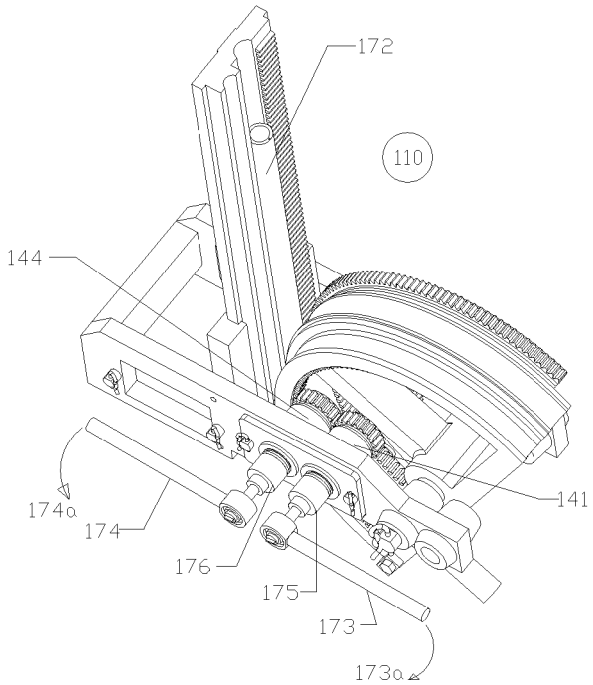
FIG. 18 is a perspective view of the pipe-bending apparatus with a bent pipe installed therein according to the second embodiment of the present invention.

FIG. 18 shows two forces 173*a* and 174*a* are being applied to two ratchets 173 and 174 with sockets 175 and 176 connected to hexagonal ends of drive-gear 141 and 144 respectively for applying torque to drive-gear 141 and 144 for bending the pipe. When ratchets 173 and 174 are applied by both hands at the same time, the applied torque to the tool is doubled, and it is easier for a person to apply the forces too.

Figure 19:
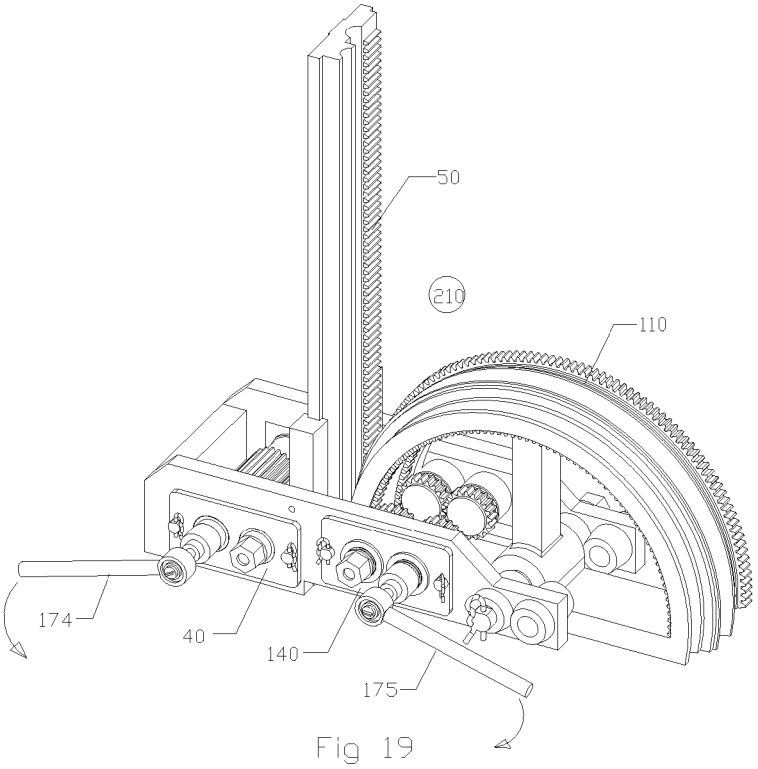
FIG. 19 is a perspective view of the pipe-bending apparatus according to the third embodiment of the present invention.

FIG. 19 shows a pipe-bending apparatus 210 according to the third embodiment of the present invention.

Pipe bending apparatus 210 including the installation of drive-gear assembly 40 (shown in FIG. 4 of the first embodiment of the present invention) into the pipe-bending apparatus 110 that was shown in FIG. 11. Ratchet 174 is used to drive drive-gear assembly 40 which in turn drives gear rack 50; and ratchet 173 is used to drive bending shoe 130, such that forces are applied more uniformly to the tool, thus causing less stresses and strains to the tool.

What is claimed is:

1. Apparatus for bending tube, pipe, and conduit comprising:

a bending shoe of generally circular wheel form mounted for rotation about a first axis and having at least one semicircular concave groove and at least one row of gear teeth on the outer peripheral surface thereof, said groove and said gear teeth located in a side by side axially spaced parallel planes perpendicular to said first axis, wherein said groove provides means for retaining a pipe on said bending shoe;

a generally cylindrical first drive-gear mounted for rotation about a second axis, having at least one row of gear teeth on its outer surface thereof; said second axis on said first drive-gear parallel to said first axis on said bending shoe;

a gear rack of generally rectangular board mounted for up and down motion along the length direction, having a first surface and a second surface opposite and parallel to said first surface, said first surface having at least one semicircular concave groove and at least one row of gear teeth thereon, and said second surface having at least one row of gear teeth thereon, said groove and said gear teeth located side by side in axially spaced parallel planes perpendicular to said first surface and said second surface; and a frame assembly pivotally supporting said first axis on said bending shoe, supporting said gear rack lengthwise, positioning said groove and said gear teeth on said first surface on said gear rack engaging to said groove and said gear teeth on said bending shoe, pivotally supporting said second axis on said first drive-gear, positioning said gear teeth on said first drive-gear engaging to said gear teeth on said second surface on said gear rack.

2. The apparatus of claim 1, further comprising:

a generally cylindrical second drive-gear mounted for rotation about a third axis, having at least one row of gear teeth on its outer circular surface thereof, said third axis on said second drive-gear is parallel to said first axis on said bending shoe; wherein said frame assembly further pivotally supporting said third axis on said second drive-gear, positioning said gear teeth on said second drive-gear engaging to said gear teeth on said first drive-gear.

3. Apparatus for bending tube, pipe, and conduit comprising:

a bending shoe of generally circular hallowed wheel form mounted for rotation about a first axis and having at least one semicircular concave groove and at least one row of outer gear teeth on the outer peripheral surface thereof, and at least one row of inner gear teeth on the inner surface opposite to said outer peripheral surface thereof, said groove and said outer gear teeth and said inner gear teeth located side by side in axially spaced parallel planes perpendicular to said first axis, wherein said groove provides means for retaining a pipe on said bending shoe;

a generally cylindrical first drive-gear mounted for rotation about a second axis, having at least one row of gear teeth on its outer surface thereof, said second axis on said first drive-gear parallel to said first axis on said bending shoe;

a gear rack of generally rectangular board mounted for up and down motion along the length direction, having a first surface and a second surface opposite and parallel to said first surface, said first surface having at least one semicircular concave groove and at least one row of gear teeth thereon, and said second surface having at least one row of gear teeth thereon, said groove and said gear teeth located side by side in axially spaced parallel planes perpendicular to said first surface and said second surface; and a frame assembly pivotally supporting said first axis on said bending shoe, supporting said gear rack lengthwise, positioning said groove and said gear teeth on said first surface on said gear rack engaging to said groove and said outer gear teeth on said bending shoe, pivotally supporting said second axis on said first drive-gear, positioning said gear teeth on said first drive-gear engaging to said inner gear teeth on said bending shoe.

4. The apparatus of claim 3, further comprising:

a generally cylindrical second drive-gear mounted for rotation about a third axis, having at least one row of gear teeth on its outer circular surface thereof, said third axis on said second drive-gear is parallel to said first axis on said bending shoe; wherein said frame assembly further pivotally supporting said third axis on said second drive-gear, positioning said gear teeth on said second drive-gear engaging to said gear teeth on said second surface on said gear rack.

5. The apparatus of claim 3, further comprising:

A generally cylindrical second drive-gear mounted for rotation about a third axis, having at least one row of gear teeth on its outer circular surface thereof, said third axis on said second drive-gear is parallel to said first axis on said bending shoe; wherein Said frame assembly further pivotally supporting said third axis on said second drive-gear, positioning said gear teeth on said second drive-gear engaging to said gear teeth on said first drive-gear.

6. The apparatus of claim 3, further comprising:

a generally cylindrical second drive-gear mounted for rotation about a third axis, having at least one row of gear teeth on its outer circular surface thereof, said third axis on said second drive-gear is parallel to said first axis on said bending shoe; wherein said frame assembly pivotally supporting said first axis on said bending shoe, supporting said gear rack lengthwise, positioning said groove and said gear teeth on said first surface on said gear rack engaging to said groove and said outer gear teeth on said bending shoe, pivotally supporting said second axis on said first drive-gear, positioning said gear teeth on said first drive-gear engaging to said gear teeth on said second surface on said gear rack, and further pivotally supporting said third axis on said second drive-gear, positioning said gear teeth on said second drive-gear engaging to said gear teeth on said first drive gear.

* * * * *